US011180833B2

(12) United States Patent
Kimura et al.

(10) Patent No.: US 11,180,833 B2
(45) **Date of Patent: *Nov. 23, 2021**

(54) CHROMIUM-BASED TWO-PHASE ALLOY AND PRODUCT USING SAID TWO-PHASE ALLOY

(71) Applicant: HITACHI, LTD., Tokyo (JP)

(72) Inventors: Tomonori Kimura, Tokyo (JP); Yasuhisa Aono, Tokyo (JP); Makoto Ogata, Tokyo (JP); Naoya Tokoo, Tokyo (JP); Yasuo Kondo, Tokyo (JP); Masafumi Noujima, Tokyo (JP)

(73) Assignee: HITACHI, LTD., Tokyo (JP)

( * ) Notice: Subject to any disclaimer, the term of this patent is extended or adjusted under 35 U.S.C. 154(b) by 253 days.

This patent is subject to a terminal disclaimer.

(21) Appl. No.: 16/086,331

(22) PCT Filed: Jan. 19, 2017

(86) PCT No.: PCT/JP2017/001626

§ 371 (c)(1),
(2) Date: Sep. 19, 2018

(87) PCT Pub. No.: WO2017/168972

PCT Pub. Date: Oct. 5, 2017

(65) Prior Publication Data

US 2019/0100825 A1 Apr. 4, 2019

(30) Foreign Application Priority Data

Mar. 30, 2016 (JP) ..... JP2016-068916

(51) Int. Cl.
*C22C 27/06* (2006.01)
*C22C 30/04* (2006.01)
(Continued)

(52) U.S. Cl.
CPC ..... *C22C 27/06* (2013.01); *B22D 21/02* (2013.01); *B22F 1/00* (2013.01); *C22C 19/05* (2013.01);
(Continued)

(58) Field of Classification Search
CPC ..... C22C 27/06; C22C 38/40; C22C 38/58; C22C 19/05; C22C 19/051; C22C 19/052;
(Continued)

(56) References Cited

U.S. PATENT DOCUMENTS 4,141,762 A * 2/1979 Yamaguchi ..... C22C 38/40 148/442
5,543,109 A 8/1996 Senba et al.
(Continued)

FOREIGN PATENT DOCUMENTS

EP 2206796 A1 7/2010
JP 55-113858 A 9/1980
(Continued)

OTHER PUBLICATIONS

International Search Report, PCT/JP2017/001626, dated Apr. 18, 2017, 1 pg.
(Continued)

*Primary Examiner* — Anthony J Zimmer
*Assistant Examiner* — Dean Mazzola
(74) *Attorney, Agent, or Firm* — Volpe Koenig

(57) ABSTRACT

There is provided a Cr-based two-phase alloy including two phases of a ferrite phase and an austenite phase that are mixed with each other. A chemical composition of the Cr-based two-phase alloy consists of a main component, an auxiliary component, impurities, a first optional auxiliary component, and a second optional auxiliary component. The main component consists of 33-61 mass % Cr, 18-40 mass % Ni and 10-33 mass % Fe, and a total content of the Ni and
(Continued)

the Fe is 37-65 mass %. The auxiliary component consists of 0.1-2 mass % Mn, 0.1-1 mass % Si, 0.005-0.05 mass % Al, and 0.02-0.3 mass % Sn. The impurities include 0.04 mass % or less of P, 0.01 mass % or less of S, 0.03 mass % or less of C, 0.04 mass % or less of N, and 0.05 mass % or less of O.

9 Claims, 6 Drawing Sheets

(51) Int. Cl.

| | |
|---|---|
| ***C22C 19/05*** | (2006.01) |
| ***C22C 38/40*** | (2006.01) |
| ***C22C 30/02*** | (2006.01) |
| ***C22F 1/11*** | (2006.01) |
| ***B22D 21/02*** | (2006.01) |
| ***B22F 1/00*** | (2006.01) |
| *C22F 1/00* | (2006.01) |

(52) U.S. Cl.
CPC ..... *C22C 30/02* (2013.01); *C22C 30/04* (2013.01); *C22C 38/40* (2013.01); *C22F 1/11* (2013.01); *B22D 21/022* (2013.01); *C22F 1/00* (2013.01)

(58) Field of Classification Search
CPC ..... C22C 19/053; C22C 19/058; C22C 30/00; C22C 30/02; C22C 30/04; C22C 38/42; C22C 38/44; C22F 1/11; C22F 1/00; C22F 1/10; B22D 21/022; B22D 21/02; B22D 21/025
See application file for complete search history.

(56) References Cited

U.S. PATENT DOCUMENTS

| | | | | |
|---|---|---|---|---|
| 10,718,038 | B2 * | 7/2020 | Noujima | B22F 9/02 |
| 2010/0166594 | A1 * | 7/2010 | Hirata et al. | C21D 6/004 420/443 |
| 2016/0346837 | A1 * | 12/2016 | Sawada | C22C 27/06 |

FOREIGN PATENT DOCUMENTS

| | | | | |
|---|---|---|---|---|
| JP | 62-260037 | A | | 11/1987 |
| JP | 03114693 | A | * | 5/1991 |
| JP | 04-301048 | A | | 10/1992 |
| JP | 04-301049 | A | | 10/1992 |
| JP | 07-216511 | A | | 8/1995 |
| JP | 07-258801 | A | | 10/1995 |
| JP | 08-291355 | A | | 11/1996 |
| JP | 10140290 | A | * | 5/1998 |
| JP | 11-302801 | A | | 11/1999 |
| JP | 2001-294967 | A | | 10/2001 |
| JP | 2006-152412 | A | | 6/2006 |
| JP | 2008-303461 | A | | 12/2008 |
| WO | WO-2013077113 | A1 | * | 5/2013 ..... B23K 35/3066 |

OTHER PUBLICATIONS

Extended European Search Report dated Aug. 28, 2019 for the European Patent Application No. 17773522.2.

* cited by examiner

CHROMIUM-BASED TWO-PHASE ALLOY AND PRODUCT USING SAID TWO-PHASE ALLOY

TECHNICAL FIELD

The present invention relates to a high corrosion resistance and high-strength alloy technology, and more particularly, to a chromium-based two-phase alloy in which two phases of an austenite phase and a ferrite phase are mixed with each other, and a product using the two-phase alloy.

BACKGROUND ART

Previously, as materials for oil well equipment used for the drilling of crude oil, natural gas, and the like, carbon steel and a corrosion inhibitor were generally used in combination. Recently, due to a change in drilling environment in accordance with an increase in depth in oil well drilling, higher corrosion resistance and mechanical properties (for example, hardness) as compared to the past are required in the materials for oil well equipment, such that a steel material (alloy steel) having excellent corrosion resistance has been used. For example, since addition of chromium (Cr) significantly improves corrosion resistance of iron (Fe), martensitic stainless steel containing 13% by mass of Cr (for example, SUS 420) is widely used in oil wells containing metal corrosive components.

However, in an environment containing chlorides and acidic gas (for example, carbon dioxide gas or hydrogen sulfide), SUS 420 has a disadvantage in that stress corrosion cracking (SCC) easily occurs. Therefore, in the case of drilling an oil well in a severe corrosive environment, an expensive nickel (Ni)-based alloy (for example, an alloy containing 40% by mass or more of Ni) has been frequently used in the related art, such that material cost (eventually, drilling cost) is greatly increased.

Meanwhile, as a corrosion resistant and heat resistant alloy cheaper than the Ni-based alloy, there are Cr-based alloys, and various Cr-based alloys have been suggested. For example, PTL 1 (JP Hei 4-301048 A) discloses a Cr—Fe based heat resistant alloy having a chemical composition containing 65 to 80% of Cr, 10 to 15% of Co, and the balance being Fe and impurities, and optionally containing 0.1 to 1.5% of N, and PTL 2 (JP Hei 4-301049 A) discloses a heat resistant alloy having a chemical composition containing 70 to 95% of Cr, 0.1 to 1.5% of N, and the balance being Fe and impurities. According to PTL 1 and PTL 2, these alloys are said to have excellent compressive deformation resistance, oxidation resistance, and the like, in a high-temperature atmosphere furnace and to contribute to improvement of durability as a supporting surface member of steel material to be heated, reduction of maintenance, and improvement furnace operation efficiency associated therewith.

PTL 3 (JP Hei 8-291355 A) discloses a Cr-based heat resistant alloy containing, by mass, more than 95% of Cr, 0.1 to 2.0% of N, and the balance being one or two or more of Fe, Ni, and Co and inevitable impurities, and further optionally containing a total of 0.3% or more of one or two or more of Ti, Al, Zr, Nb, B, and V. According to PTL 3, it is said that a Cr-based heat-resistant alloy excellent in high-temperature strength, which is used for a member that needs strength, ductility and corrosion resistance at a super-high temperature (for example, a support member of steel material to be heated in a heating furnace) can be provided.

Further, PTL 4 (JP Hei 7-258801 A) discloses a Fe—Cr—Ni alloy having excellent corrosion resistance in a processed portion, characterized in that the Fe—Cr—Ni alloy consists of 15 to 50% of Cr, 6.1 to 50% of Ni, 200 ppm or less of O+P+S, and the balance being Fe and inevitable impurities, has a grain size number of 8 or more, and optionally contains 400 to 1200 ppm of C+N. According to PTL 4, it is said that a Fe—Cr—Ni alloy capable of improving corrosion resistance without deteriorating processability and capable of preventing corrosion resistance from being deteriorated even in the case of being processed can be provided.

CITATION LIST

Patent Literature

PLT 1: JP Hei 4 (1992)-301048 A;
PLT 2: JP Hei 4 (1992)-301049 A;
PLT 3: JP Hei 8 (1996)-291355 A; and
PLT 4: JP Hei 7 (1995)-258801 A.

SUMMARY OF THE INVENTION

Problems to be Solved by the Invention

A high Cr-based alloy (an alloy having a high content of Cr) as described in PTL 1 to PTL 3 is intended for use under a high-temperature environment of 1300° C. or higher, and is said to have excellent corrosion resistance and mechanical properties even under the high-temperature environment. However, since the high Cr-based alloy as described above exhibits brittleness (poor toughness) in a temperature range (room temperature to about 350° C.) under an oil well environment, the high Cr-based alloy is thought to be unsuitable as a material for oil well equipment.

Further, although the Fe—Cr—Ni alloy disclosed in PTL 4 is intended for austenitic stainless steel, it is known that in the austenitic stainless steel, stress corrosion cracking (SCC) is liable to occur due to hydrogen embrittlement in a high-temperature and high-pressure environment containing chloride, and the Fe—Cr—Ni alloy is though to be unsuitable as a material for oil well equipment similarly to the high Cr-based alloy.

As described above, in accordance with an increase in depth in oil well drilling, a metal material which has high corrosion resistance and mechanical properties that are at least equivalent to those in a conventional one and which is cheaper than a Ni-based alloy has been urgently required. Incidentally, as the mechanical properties of the material for oil well equipment, in view of durability, it is important to secure ductility and toughness in addition to hardness and mechanical strength. Further, abrasion resistance is also an important mechanical property when the material is used as a material of a sliding part of equipment.

Therefore, an object of the present invention is to provide a low cost Cr-based two-phase alloy having high corrosion resistance and good mechanical properties that are at least equivalent to those in a conventional technology as a metal material capable of being preferably used in a temperature range such as an oil well and a high-corrosion environment, and a product using said two-phase alloy.

Solution to Problems (I) An aspect of the present invention is to provide a Cr-based two-phase alloy including two phases of a ferrite phase and an austenite phase that are mixed with each other, in which a chemical composition of the Cr-based two-phase alloy consists of a main component, an auxiliary component, impurities, a first optional auxiliary component, and a second optional auxiliary component, the main component consists of 33% by mass or more to 61% by mass or less of Cr, 18% by mass or more to 40% by mass or less of Ni (nickel), and 10% by mass or more to 33% by mass or less of Fe (iron), and a total content of the Ni and the Fe is 37% by mass or more to 65% by mass or less, the auxiliary component consists of 0.1% by mass or more to 2% by mass or less of Mn (manganese), 0.1% by mass or more to 1% by mass or less of Si (silicon), 0.005% by mass or more to 0.05% by mass or less of Al (aluminum), and 0.02% by mass or more to 0.3% by mass or less of Sn (tin), and the impurities contain more than 0% by mass to 0.04% by mass or less of P (phosphorus), more than 0% by mass to 0.01% by mass or less of S (sulfur), more than 0% by mass to 0.03% by mass or less of C (carbon), more than 0% by mass to 0.04% by mass or less of N (nitrogen), and more than 0% by mass to 0.05% by mass or less of O (oxygen).

Further, in the present invention, the first optional auxiliary component and the second optional auxiliary component mean components that may be added or may not be added.

In the present invention, the following improvement or modifications can be made to the Cr-based two-phase alloy (I) according to the above-mentioned present invention.

(i) When the Cr-based two-phase alloy contains the first optional auxiliary component, the first optional auxiliary component is 0.1% by mass or more to 3% by mass or less of Mo (molybdenum) and/or 0.1% by mass or more to 5% by mass or less of Cu (copper).

(ii) The second optional auxiliary component consists of at least one of V (vanadium), Nb (niobium), Ta (tantalum), and Ti (titanium), and when the Cr-based two-phase alloy contains the second optional auxiliary component, a total atomic content of V, Nb, Ta, and Ti is in a range of 0.8 times or more to 2 times or less a total atomic content of C, N, and O.

(iii) An occupation ratio of the ferrite phase is 10% or more to 95% or less.

(II) Another aspect of the present invention is to provide a two-phase alloy product which is a product using a two-phase alloy, in which the two-phase alloy is the Cr-based two-phase alloy.

In the present invention, the following improvements or modifications can be made to the two-phase alloy product (II) according to the above-mentioned present invention.

(iv) The product is a molded body having a cast structure.

(v) The product is a molded body having a forged structure.

(vi) The product is a powder.

(vii) The product is a composite body in which a coating layer of the two-phase alloy is formed on a substrate, and the coating layer has a rapid solidification structure.

Advantageous Effects of the Invention

According to the present invention, it is possible to provide a low cost Cr-based two-phase alloy having high corrosion resistance and good mechanical properties that are at least equivalent to those in a conventional technology as a metal material capable of being preferably used in a temperature range such as an oil well and a high-corrosion environment, and a product using the two-phase alloy.

DETAILED DESCRIPTION OF THE PREFERRED EMBODIMENTS

Figure 1:
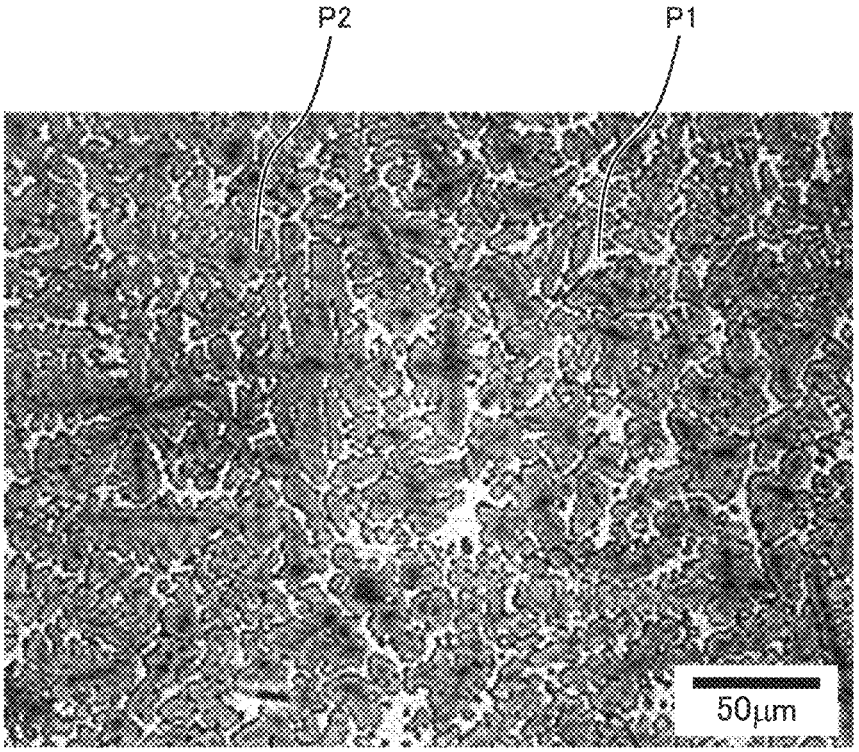
FIG. 1 is an optical microscope photograph illustrating an example of a metal structure of a sample obtained by ordinary casting as an example of a two-phase alloy product according to the present invention.

The present inventors diligently investigated and examined relationships between a chemical composition, a shape of a metal structure, mechanical properties, and corrosion resistance in a Cr—Ni—Fe alloy containing Cr, Ni and Fe as main components, particularly a Cr—Ni—Fe alloy containing 33% by mass or more of Cr and a product thereof, thereby completing the present invention.

Hereinafter, exemplary embodiments of the present invention are described in detail with reference to the accompanying drawings. However, the present invention is not limited to the exemplary embodiments but may be suitably combined or modified without departing from the technical idea of the present invention.

(Chemical Composition of Cr-Based Two-Phase Alloy of Present Invention)

As described above, a two-phase alloy according to the present invention is a Cr—Ni—Fe based alloy containing Cr, Ni, and Fe as main components, and contains at least Mn, Si, Al, and Sn as auxiliary components and impurities. The two-phase alloy may optionally contain Mo and/or Cu. Further, it is preferable that the two-phase alloy further contains at least one of optional V, Nb, Ta, and Ti. Hereinafter, a composition (each component) of the two-phase alloy according to the present invention is described.

Cr: 33% by Mass or More to 61% by Mass or Less

A Cr component, which is one of the main components of the present Cr-based two-phase alloy, is a component that is solid-dissolved in an austenite phase while forming a high-strength ferrite phase to contribute to improving corrosion resistance. A content of the Cr component is preferably 33% by mass or more to 61% by mass or less. When the content of Cr is less than 33% by mass, mechanical strength of the Cr-based two-phase alloy is deteriorated. On the other hand, when the content of Cr is more than 61% by mass, ductility and toughness of the Cr-based two-phase alloy are deteriorated. Further, in view of corrosion resistance and a material cost, it is preferable that the content of Cr among the main three components (Cr, Ni, and Fe) is the largest.

Ni: 18 to 40% by Mass

A Ni component, which is one of the main components of the two-phase alloy, is a component imparting ductility and toughness to the two-phase alloy while stabilizing an austenite phase to contribute to maintaining a two-phase state of the alloy (for example, capable of maintaining the two-phase state even in the case of performing solution treatment). A content of the Ni component is preferably 18% by mass or more to 40% by mass or less, and more preferably, 20% by mass or more to 40% by mass or less. When the content of Ni is less than 18% by mass, an occupation ratio of the austenite phase is less than 5% (a ferrite ratio is more than 95%), and ductility and toughness of the two-phase alloy are deteriorated. On the other hand, when the content of Ni is more than 40% by mass, the ferrite ratio is less than 10% (the occupation ratio of the austenite phase is more than 90%), and mechanical strength of the two-phase alloy is deteriorated.

Fe: 10 to 33% by Mass

An Fe component, which is also one of the main components of the two-phase alloy, is a basic component for securing mechanical strength. A content of the Fe component is preferably 10% by mass or more to 33% by mass or less. When the content of Fe is less than 10% by mass, ductility and toughness of the two-phase alloy are deteriorated. On the other hand, when the content of Fe is more than 33% by mass, a σ phase of an intermetallic compound may be easily formed in a temperature region around 800° C., and ductility and toughness of the two-phase alloy are significantly deteriorated (so called, σ phase embrittlement). In other words, it is possible to suppress formation of the σ phase while securing mechanical strength of the two-phase alloy by controlling the content of Fe in a range of 10 to 33% by mass, thereby making it possible to suppress deterioration of ductility and toughness of the alloy.

Ni+Fe: 37 to 65% by Mass

A total content of a Ni component and an Fe component is preferably 37% by mass or more to 65% by mass or less. When the total content is less than 37% by mass, ductility and toughness of the two-phase alloy are poor. On the other hand, when the total content is more than 65% by mass, mechanical strength of the alloy is significantly deteriorated.

Mn: 0.1 to 2% by Mass

A Mn component is an auxiliary component playing a role of desulfurization and deoxidation in the two-phase alloy and contributing to improving mechanical strength and ductility and improving carbon dioxide corrosion resistance. A content of the Mn component is preferably 0.1% by mass or more to 2% by mass or less, and more preferably 0.3% by mass or more to 1.8% by mass or less. When the content of Mn is less than 0.1% by mass, an effect of the Mn component cannot be sufficiently obtained. Further, when the content of Mn is more than 2% by mass, coarse particles of sulfide (for example, MnS) are formed, which causes deterioration of corrosion resistance or mechanical strength of the alloy.

Si: 0.1 to 1% by Mass

A Si component is an auxiliary component playing a role of deoxidation in the two-phase alloy and contributing to improving mechanical strength and toughness. A content of the Si component is preferably 0.1% by mass or more to 1% by mass or less, and more preferably, 0.3% by mass or more to 0.8% by mass or less. When the content of Si is less than 0.1% by mass, an effect of the Si component cannot be sufficiently obtained. Further, when the content of Si is more than 1% by mass, coarse particles of oxide (for example, $SiO_2$) are formed, which causes deterioration of ductility and toughness of the alloy.

Al: 0.005 to 0.05% by Mass

An Al component is an auxiliary component playing a role of deoxidation and denitrification in the two-phase alloy and contributing to improving mechanical strength and toughness. A content of the Al component is preferably 0.005% by mass or more to 0.05% by mass or less, and more preferably, 0.008% by mass or more to 0.04% by mass or less. When the content of Al is less than 0.005% by mass, an effect of the Al component cannot be sufficiently obtained. Further, when the content of Al is more than 0.05% by mass, coarse particles of oxide or nitride (for example, $Al_2O_3$ or AlN) are formed, which causes deterioration of ductility and toughness of the alloy.

Sn: 0.02 to 0.3% by Mass

A Sn component is an auxiliary component playing a role of reinforcement of a passivation film in the two-phase alloy and contributing to improving corrosion resistance and abrasion resistance. A content of the Sn component is preferably 0.02% by mass or more to 0.3% by mass or less, and more preferably 0.05% by mass or more to 0.3% by mass or less. When the content of Sn is less than 0.02% by mass, an effect of the Sn component cannot be sufficiently obtained. Further, when the content of Sn is more than 0.3% by mass, grain boundary segregation of the Sn component may be generated, which causes deterioration of ductility and toughness of the alloy.

Impurities

Examples of the impurities in the two-phase alloy include P, S, C, N, and O. Hereinafter, these impurities are described.

P: More than 0% by Mass to 0.04% by Mass or Less

A P component is an impurity component that easily segregates at a grain boundary of the two-phase alloy and deteriorates toughness of the alloy and corrosion resistance at the grain boundary. It is possible to suppress negative influences of the P component by controlling a content of the P component to be 0.04% by mass or less. It is more preferable that the content of P is 0.03% by mass or less.

S: More than 0% by Mass to 0.01% by Mass or Less

An S component is an impurity component combining with the constituent components of the two-phase alloy to easily form a sulfide (for example, Fe sulfide) having a relatively low melting point, and deteriorating toughness or pitting corrosion resistance of the alloy. It is possible to suppress negative influences of the S component by controlling a content of the S component to be 0.01% by mass or less. It is more preferable that the content of S is 0.003% by mass or less.

C: More than 0% by Mass to 0.03% by Mass or Less

A C component is an impurity component having an effect of hardening the alloy by being solid-dissolved in the alloy, but the C component is also an impurity component combining with the constituent components of the two-phase alloy to easily form and precipitate carbides (for example, Cr carbides) at the grain boundary, and deteriorating corrosion resistance or toughness of the alloy. It is possible to suppress negative influences of the C component by controlling a content of the C component to be 0.03% by mass or less. It is more preferable that the content of C is 0.02% by mass or less.

N: More than 0% by Mass to 0.04% by Mass or Less

An N component has an effect of improving mechanical properties (for example, hardness) by being solid-dissolved in the present Cr-based two-phase alloy. A content of the N component is preferably more than 0% by mass to 0.04% by mass or less, more preferably, more than 0% by mass to 0.03% by mass or less, and further more preferably more than 0% by mass to 0.02% by mass or less. When the N component is not added, it is impossible to obtain the effect of the N component. Further, when the content of N is more than 0.04% by mass, N combines with the constituent components of the Cr-based two-phase alloy to form and precipitate nitrides (for example, Cr nitrides), and deteriorates ductility and toughness of the Cr-based two-phase alloy.

O: More than 0% by Mass to 0.05% by Mass or Less

An O component is an impurity component combining with the constituent components of the two-phase alloy to easily form and precipitate oxides (for example, Fe oxides), and deteriorating toughness of the alloy. It is possible to suppress negative influences of the O component by controlling a content of the O component to be 0.05% by mass or less. The content of O is preferably 0.03% by mass or less, and more preferably 0.02% by mass or less.

First Optional Auxiliary Component

It is preferable that the two-phase alloy further contains Mo and/or Cu as the first optional auxiliary component. Hereinafter, the first optional auxiliary component is described. Incidentally, as described above, the first optional auxiliary component means a component that may be added or may not be added.

Mo: 0.1 to 3% by Mass

A Mo component is an optional auxiliary component contributing to improving corrosion resistance in the two-phase alloy. In the case of adding the Mo component, a content of the Mo component is preferably 0.1% by mass or more to 3% by mass or less, and more preferably, 0.5% by mass or more to 2% by mass or less. When the content of Mo is less than 0.1% by mass, an effect of the Mo component cannot be sufficiently obtained. Further, when the content of Mo is more than 3% by mass, ductility and toughness of the alloy are deteriorated.

Cu: 0.1 to 5% by Mass

A Cu component is an optional auxiliary component contributing to improving corrosion resistance in the two-phase alloy. In the case of adding the Cu component, a content of the Cu component is preferably 0.1% by mass or more to 5% by mass or less, and more preferably, 0.3% by mass or more to 3% by mass or less. When the content of Cu is less than 0.1% by mass, an effect of the Cu component cannot be sufficiently obtained. Further, when the content of Cu is more than 5% by mass, ductility and toughness of the alloy are deteriorated.

Second Optional Auxiliary Component

It is preferable that the two-phase alloy contains at least one of V, Nb, Ta, and Ti as a second optional auxiliary component. Hereinafter, the second optional auxiliary component is described. Incidentally, as described above, the second optional auxiliary component means a component that may be added or may not be added.

A V component, an Nb component, a Ta component, and a Ti component are components playing roles of decarbonization, denitrification, and deoxidation in the two-phase alloy. These components can improve toughness of the alloy (can suppress deterioration of toughness) by forming compounds with the impurity components such as C, N, and O and aggregating and stabilizing these impurity components.

Further, addition of a small amount of the V component has a secondary effect of improving mechanical properties (for example, hardness) of the alloy. Addition of a small amount of the Nb component also has a secondary effect of improving mechanical properties (for example, toughness) of the alloy. Addition of a small amount of the Ta component or the Ti component has a secondary effect of improving corrosion resistance of the alloy.

A total atomic content (at o) of the second optional auxiliary component is controlled preferably in a range of 0.8 times or more to 2 times or less a total atomic content (at %) of C, N, and O of the impurity components, and more preferably in a range of 0.8 times or more to 1.5 times or less the total atomic content (at o) of C, N, and O of the impurity components. When the total atomic content of the second optional auxiliary component is less than 0.8 times the total atomic content of C, N, and O, the above-mentioned effect cannot be sufficiently obtained. On the contrary, when the total atomic content of the second optional auxiliary component is more than 2 times the total atomic content of C, N, and O, ductility and toughness of the alloy are deteriorated.

(Metal Structure of Cr-Based Two-Phase Alloy Product of Present Invention)

Next, a metal structure (micro-structure) of the Cr-based two-phase alloy according to the present invention is described.

The alloy according to the present invention is a Cr—Ni—Fe-based alloy containing Cr, Ni, and Fe as the main components. Generally, a metal structure of an alloy containing Fe as a main component is largely divided into a ferrite structure having a body-centered cubic lattice crystal structure (also referred to as a ferrite phase or an $\alpha$ phase), an austenite structure having a face-centered cubic lattice crystal structure (also referred to as an austenite phase or a $\gamma$ phase), and a martensite structure (also referred to as a martensite phase or an $\alpha'$ phase) having a strained body-centered cubic lattice crystal structure.

Generally, it is considered that the ferrite phase has excellent corrosion resistance (for example, SCC resistance) and high mechanical strength (for example, 0.2% proof stress), but ductility and toughness thereof are relatively low as compared to the austenite phase. It is considered that the austenite phase has relatively high ductility and toughness as compared to the ferrite phase, but mechanical strength thereof is relatively low. Further, it is considered that the austenite phase has high corrosion resistance in a general environment, but SCC resistance thereof is rapidly deteriorated when a corrosion environment becomes severe. It is considered that the martensite phase has high mechanical strength (for example, hardness) but corrosion resistance thereof is relatively low.

Meanwhile, the two-phase alloy according to the present invention is an alloy having a phase structure in which two phases of the austenite phase and the ferrite phase are mixed. The two-phase alloy simultaneously has advantages (excellent ductility and toughness) of the austenite phase and advantages (high mechanical strength and excellent corrosion resistance including SCC resistance) of the ferrite phase. Further, the two-phase alloy has an advantage in that it simultaneously has good ductility and abrasion resistance from its characteristic chemical composition. In addition, the two-phase alloy has an advantage in that since the two-phase alloy contains Cr that is cheaper than Ni as the main component, a material cost may be decreased as compared to a Ni-based alloy containing Ni as a maximum component.

It is preferable to control the two-phase alloy according to the present invention so that an occupation ratio of the ferrite phase (hereinafter, also simply referred to as a "ferrite ratio") is 10% or more to 95% or less, and the balance (that is, 90% or less to 5% or more) is the austenite phase. In the present invention, an occupation ratio of a phase is defined as a content (unit: %) of the corresponding phase at the time of performing electron backscattered diffraction pattern (EBSP) analysis on a polished surface of an alloy bulk sample.

When the ferrite ratio is out of the range of 10% or more to 95% or less, advantages of the two-phase alloy are hardly obtained (a disadvantage of a ferrite single phase or a disadvantage of an austenite single phase is clearly exhibited). It is more preferable to control the ferrite ratio to be 15% or more to 85% or less, and it is further more preferable to control the ferrite ratio to be 20% or more to 70% or less.

Further, the metal structure (micro-structure) of the two-phase alloy product according to the present invention may be a cast structure, a forged structure, or a rapid solidification structure. In other words, the product may be molded and formed by casting, forging, or rapid solidification using the two-phase alloy according to the present invention. In addition, the metal structure of the two-phase alloy product may be a metal structure subjected to solution heat treatment after molding and forming or a metal structure additionally subjected to aging heat treatment after the solution heat treatment.

In view of mechanical properties and corrosion resistance, it is preferable that the two-phase alloy has a metal structure having a small grain diameter (for example, the forged structure or the rapid solidification structure). In other words, when the priority is to secure mechanical properties or corrosion resistance, it is preferable to mold and form the two-phase alloy product by forging or rapid solidification. On the other hand, when a product having a complicated shape is manufactured or the priority is cost, it is preferable to mold and form a two-phase alloy product by casting.

FIG. 1 is an optical microscope photograph illustrating an example of a metal structure of a sample obtained by ordinary casting as an example of the two-phase alloy product according to the present invention. As illustrated in FIG. 1, it is confirmed that the sample has a metal structure in which a light-colored austenite phase P1 and a dark colored ferrite phase P2 are dispersed and mixed with each other. Further, since the sample of FIG. 1 is a molded body by ordinary casting, a structure (so-called cast structure) in which a dendritic crystal (dendrite) peculiar to cast solidification has crystallized is confirmed.

Figure 2:
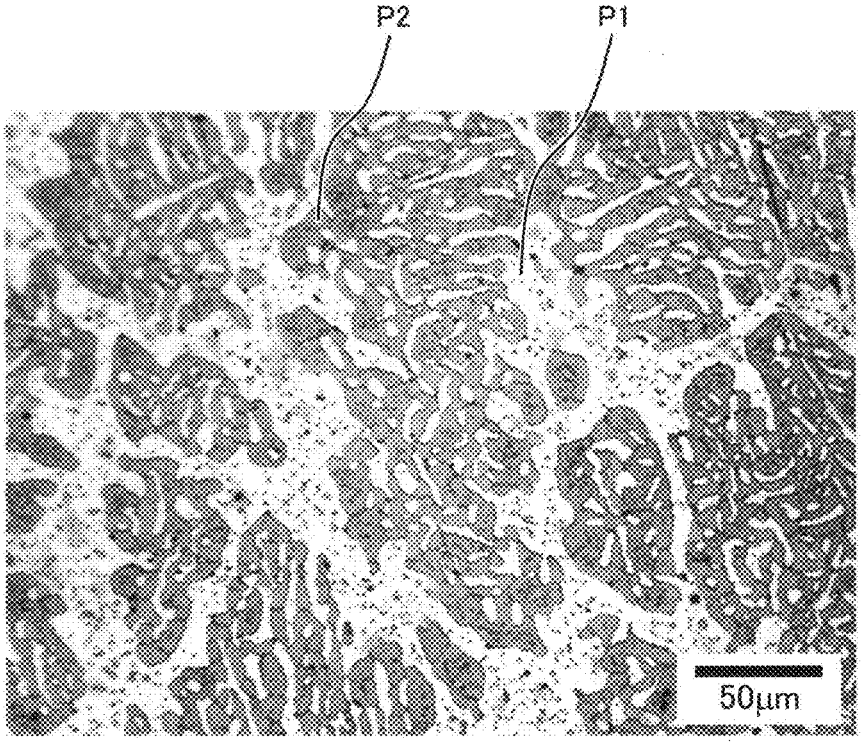
FIG. 2 is an optical microscope photograph illustrating an example of a metal structure of a sample obtained by hot forging as another example of a two-phase alloy product according to the present invention.

FIG. 2 is an optical microscope photograph illustrating an example of a metal structure of a sample obtained by hot forging as another example of the two-phase alloy product according to the present invention. Similarly to FIG. 1, it is confirmed that the sample has a metal structure in which a light-colored austenite phase P1 and a dark colored ferrite phase P2 are dispersed and mixed with each other. Further, since the sample of FIG. 2 is a molded body by hot forging, a structure (so-called forged structure) in which a cast structure is destroyed and equiaxed grains are at least partially shown is confirmed.

Figure 3:
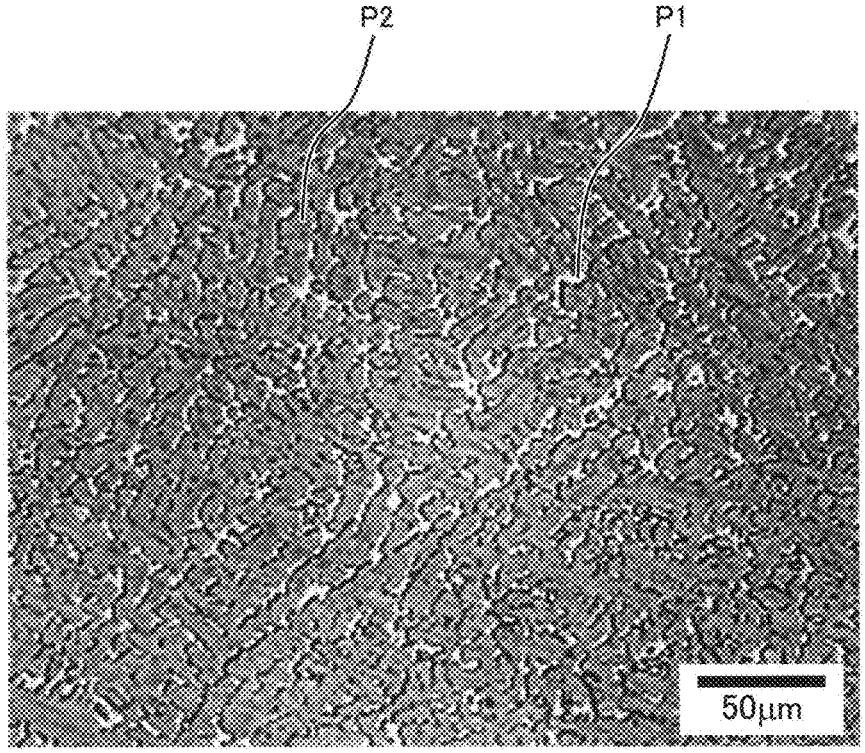
FIG. 3 is an optical microscope photograph illustrating an example of a metal structure of a sample obtained by rapid solidification as another example of a two-phase alloy product according to the present invention.

FIG. 3 is an optical microscope photograph illustrating an example of a metal structure of a sample obtained by rapid solidification as another example of the two-phase alloy product according to the present invention. FIG. 3 illustrates a surface of a weld metal on which build-up welding was performed using the two-phase alloy of the present invention. Similarly to FIGS. 1 and 2, it is confirmed that the sample has a metal structure in which a light-colored austenite phase P1 and a dark colored ferrite phase P2 are dispersed and mixed with each other. In addition, since the sample of FIG. 3 is a sample obtained by rapid solidification, an average grain diameter is small, and a structure such as a dendrite sprout (a structure starting to become dendrite, so-called rapid solidification structure) is confirmed. Further, it was separately confirmed that two-phase alloy powder manufactured by an atomizing method had the same metal structure as in FIG. 3.

(Manufacturing Method of Cr-Based Two-Phase Alloy Product of Present Invention)

Figure 4:
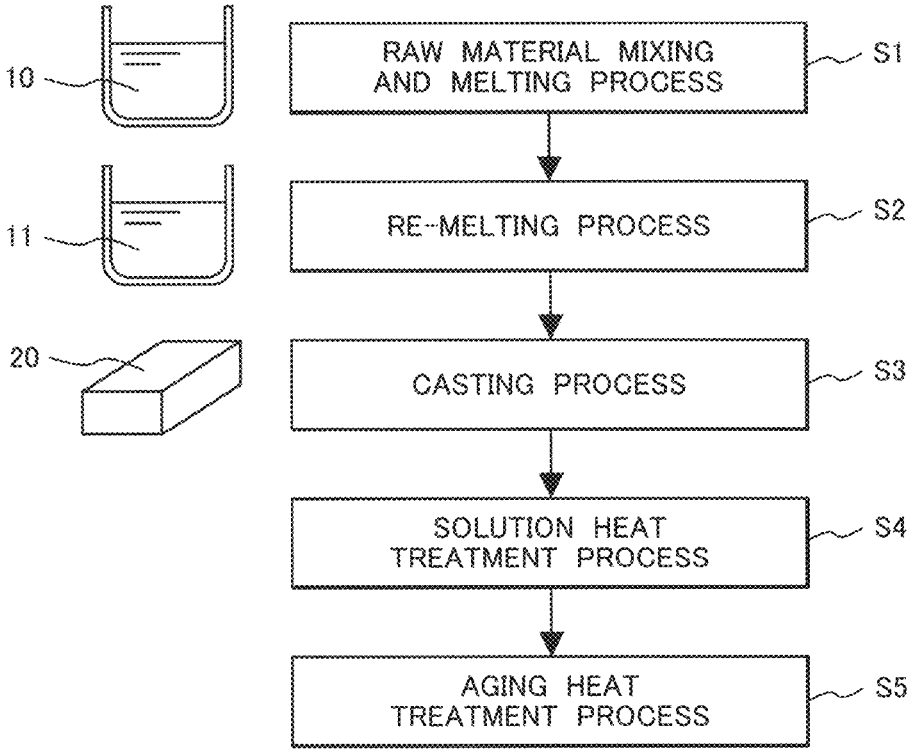
FIG. 4 is a process chart illustrating an example of a manufacturing method of a two-phase alloy product according to the present invention (a manufacturing method of a casting product)

Next, a manufacturing method of a two-phase alloy product according to the present invention is described. FIG. 4 is a process chart illustrating an example of a manufacturing method of a two-phase alloy product according to the present invention (a manufacturing method of a casting product).

As illustrated in FIG. 4, in this manufacturing method, first, a raw material mixing and melting process (step 1: S1) of mixing and melting raw materials of the two-phase alloy to form a molten metal 10 to have a desired composition (main components+auxiliary components+first and second optional auxiliary components as necessary) is performed. A mixing method or melting method of the raw materials is not particularly limited, but conventional methods for manufacturing a high corrosion resistance and high-strength alloy can be used. For example, as the melting method, a vacuum melting method can be preferably used. Further, it is preferable to refine the molten metal 10 by combining a vacuum carbon deoxidation method, or the like. In the raw material mixing and melting process S1, the molten metal 10 is solidified once at the end of the process to form a raw material alloy lump.

Next, a re-melting process (step 2: S2) for controlling contents of impurity components (P, S, C, N, and O) in the alloy (for increasing cleanness of the alloy) is performed. A re-melting method is not particularly limited as long as cleanness of the alloy can be enhanced. For example, vacuum arc re-melting (VAR) or electroslag re-melting (ESR) can be preferably used. A cleaned molten metal 11 is prepared by this process.

Next, a casting process (step 3: S3) of injecting the cleaned molten metal 11 into a desired mold to form an ingot 20 is performed. Here, it is possible to secure a cooling rate at which grain coarsening (coarse cast solidification structure) at the time of solidification can be suppressed, and in the case in which it is possible to cast the ingot 20 in a near final shape with high dimensional accuracy (including a case of casting by molten metal forging), the two-phase alloy product according to the present invention may be manufactured using the ingot 20 by this casting process.

After the casting process S3, if necessary, a solution heat treatment process (step 4: S4) for performing solution treatment on the ingot 20 may be performed. A temperature of solution heat treatment is preferably in a range of 1050 to 1300° C., and more preferably in a range of 1100 to 1250° C. A chemical composition in each of the austenite phase and the ferrite phase can be homogenized by performing solution treatment.

In addition, it is preferable to perform an aging heat treatment process (step 5: S5) after the solution heat treatment process S4. A temperature of aging heat treatment is preferably in a range of 800 to 1000° C., and more preferably around 900° C. A heat treatment time may be suitably adjusted in a range of 0.5 to 6 hours. Phase ratios of two phases (the ferrite ratio) can be adjusted by performing aging heat treatment.

For example, when an amount of the ferrite phase is excessively large as compared to the ferrite ratio predicted from a blending composition, the ferrite phase is partially transformed to the austenite phase by performing this aging heat treatment thereon, thereby making it possible to adjust the ductility and toughness of the product. On the contrary, when the amount of the ferrite phase is too small as compared to the ferrite ratio predicted from the blending composition (that is, the austenite phase is excessively present), the austenite phase can be partially transformed to the ferrite phase, thereby making it possible to adjust mechanical strength of the product.

Further, when the two-phase alloy contains the second optional auxiliary component, formation of a compound of the second optional auxiliary component and the impurity components (C, N, or O) in addition to the above-mentioned phase ratio adjustment are simultaneously promoted by performing this aging heat treatment, such that the impurity component can be further gathered and stabilized. As a result, ductility and toughness of the product can be further improved (that is, deterioration of ductility and toughness can be further suppressed).

Figure 5:
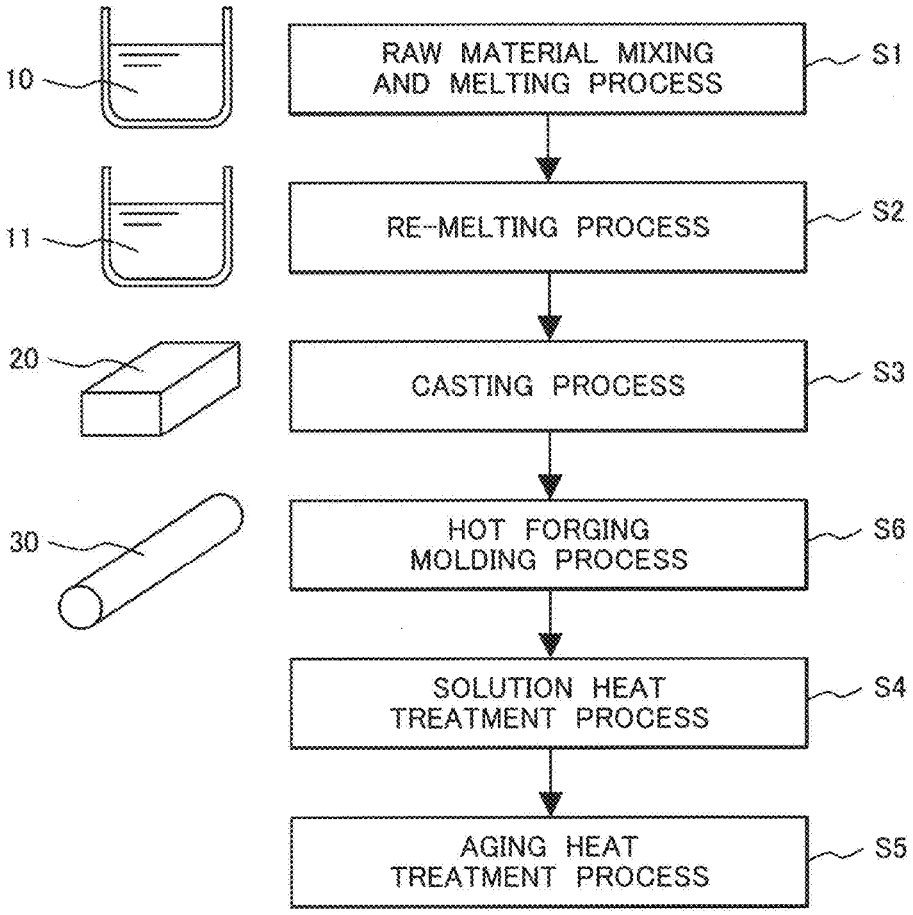
FIG. 5 is a process chart illustrating another example of a manufacturing method of a two-phase alloy product according to the present invention (a manufacturing method of a forging product)

FIG. 5 is a process chart illustrating another example of the manufacturing method of a two-phase alloy product according to the present invention (a manufacturing method of a forging product). As illustrated in FIG. 5, the manufacturing method of the forging product is different in that the manufacturing method of the forging product has a hot forging molding process (step 6: S6) between the casting process S3 and the solution heat treatment process S4 in the manufacturing method of the casting product of FIG. 4, and other processes are the same as described above. Therefore, only the hot forging molding process S6 is described.

In the manufacturing method of the forging product, the hot forging molding process S6 of performing hot forging on the ingot 20 obtained in the casting process S3 so as to be molded in a near final shape is performed. The hot forging molding method is not particularly limited, and conventional methods can be used. However, it is preferable that this hot forging molding process is performed in a temperature range of 900 to 1300° C. By performing hot forging within the above-mentioned temperature range (without deviating from the temperature range during the hot forging), casting defects of the ingot 20 disappear and a cast solidification structure is broken, such that a molded body 30 of a two-phase alloy having a forged structure with a grain diameter smaller than that of the cast structure can be obtained.

Figure 6:
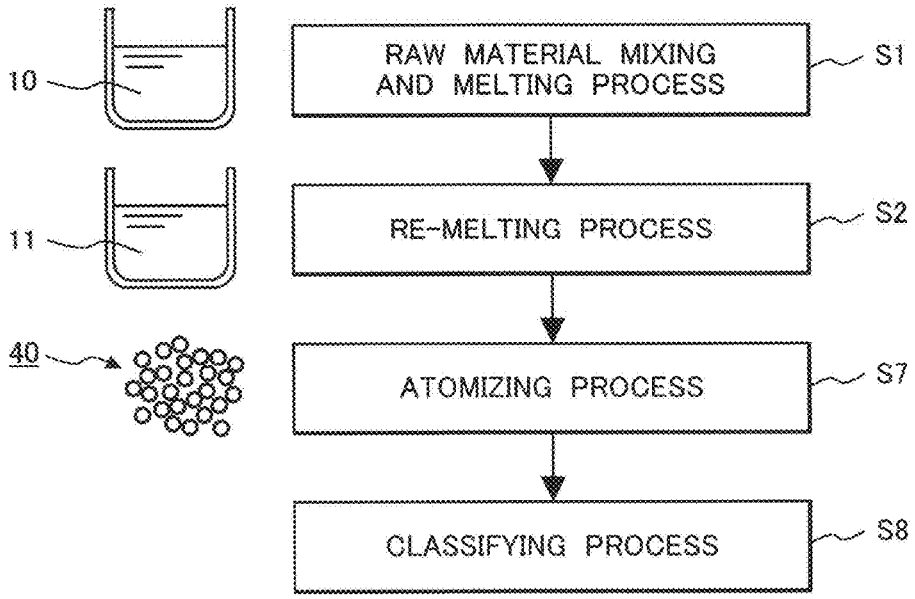
FIG. 6 is a process chart illustrating another example of a manufacturing method of a two-phase alloy product according to the present invention (a manufacturing method of powder)

FIG. 6 is a process chart illustrating another example of the manufacturing method of a two-phase alloy product according to the present invention (a manufacturing method of powder). As illustrated in FIG. 6, the manufacturing method of the powder is different in that a raw material mixing and melting process S1 and a re-melting process S2 are the same as those in the manufacturing method of FIGS. 4 to 5, but an atomizing process (step 7: S7) and a classifying process (step 8: S8) are performed instead of the casting process S3. Therefore, only the atomizing process S7 and the classifying process S8 are described.

In the manufacturing method of powder, the atomizing process S7 of forming alloy powder 40 from the cleaned molten metal 11 is performed. An atomizing method is not particularly limited, but a conventional atomizing method can be used. For example, a gas atomizing method capable of obtaining particles having high cleanness, a homogeneous composition, and a spherical shape can be preferably used.

After the atomizing process S7, if necessary, the classifying process S8 for adjusting the alloy powder 40 to a desired particle size may be performed. Although there is no particular limitation in the particle size to be classified, in view of a handling property, it is preferable to classify the alloy powder 40 so as to have an average particle size of, for example, 10 μm or more to 200 μm or less. The obtained alloy powder 40 can be preferably used, for example, as a welding material, a material for powder metallurgy, and a material for laminate molding.

Since the two-phase alloy product manufactured as described above consists of a two-phase alloy whose main component is Cr cheaper than Ni, the two-phase alloy can have high corrosion resistance and mechanical properties that are at least equivalent to those in a conventional technology, and at the same time, the cost can be decreased as compared to a product made of a Ni-based alloy. As a result, the Cr-based two-phase alloy product according to the present invention can be preferably used as an oil well equipment member (for example, a compressor member or a pump member), a seawater environmental equipment member (for example, a member of seawater desalination plant equipment or an umbilical cable), or a chemical plant equipment member (for example, a liquefied natural gas vaporization device member).

EXAMPLES

Hereinafter, the present invention is described in more detail through Examples and Comparative Examples. However, the present invention is not limited to those Examples.

Experiment 1

Manufacturing of Alloy Products of Examples 1 to 26 and Comparative Examples 1 to 5

Alloy products (Examples 1 to 26 and Comparative Examples 1 to 5) were manufactured using alloys A1 to A25 having chemical compositions illustrated in Table 1, respectively. A content (unit: % by mass) of each component was converted so that a total content of the chemical composition illustrated in Table 1 was 100% by mass. In addition, the alloy A25 is commercial two-phase stainless steel referred to as super two-phase steel.

TABLE 1

Chemical Compositions of Alloys A1 to A25.

| | | Chemical Composition [% by mass] | | | | | | | | | | | | | |
|---|---|---|---|---|---|---|---|---|---|---|---|---|---|---|---|
| | Alloy No. | Si | Mn | Al | P | S | Cr | Ni | Fe | Sn | Mo | Cu | C | N | O |
| Example | A1 | 0.57 | 1.26 | 0.014 | 0.017 | 0.0010 | bal. | 26.08 | 11.87 | 0.17 | | | 0.010 | 0.017 | 0.012 |
| | A2 | 0.49 | 1.31 | 0.024 | 0.012 | 0.0014 | bal. | 33.14 | 12.22 | 0.19 | | | 0.013 | 0.012 | 0.010 |
| | A3 | 0.52 | 1.29 | 0.016 | 0.019 | 0.0020 | bal. | 38.92 | 11.26 | 0.19 | | | 0.018 | 0.016 | 0.016 |

TABLE 1-continued

Chemical Compositions of Alloys A1 to A25.

| | Alloy No. | Chemical Composition [% by mass] | | | | | | | | | | | | | |
|---|---|---|---|---|---|---|---|---|---|---|---|---|---|---|---|
| | | Si | Mn | Al | P | S | Cr | Ni | Fe | Sn | Mo | Cu | C | N | O |
| | A4 | 0.59 | 1.40 | 0.018 | 0.011 | 0.0015 | bal. | 21.06 | 19.71 | 0.20 | | | 0.020 | 0.012 | 0.014 |
| | A5 | 0.57 | 1.31 | 0.020 | 0.017 | 0.0022 | bal. | 30.79 | 21.24 | 0.08 | | | 0.015 | 0.010 | 0.012 |
| | A6 | 0.48 | 1.35 | 0.016 | 0.020 | 0.0023 | bal. | 30.25 | 19.68 | 0.18 | | | 0.018 | 0.015 | 0.011 |
| | A7 | 0.50 | 1.28 | 0.028 | 0.013 | 0.0019 | bal. | 29.71 | 20.39 | 0.28 | | | 0.013 | 0.011 | 0.014 |
| | A8 | 0.61 | 1.44 | 0.016 | 0.017 | 0.0018 | bal. | 37.44 | 20.73 | 0.17 | | | 0.015 | 0.008 | 0.013 |
| | A9 | 0.52 | 1.39 | 0.030 | 0.014 | 0.0012 | bal. | 20.09 | 27.51 | 0.18 | | | 0.021 | 0.012 | 0.018 |
| | A10 | 0.58 | 1.46 | 0.017 | 0.018 | 0.0020 | bal. | 25.98 | 30.05 | 0.07 | | | 0.017 | 0.012 | 0.013 |
| | A11 | 0.66 | 1.28 | 0.014 | 0.022 | 0.0021 | bal. | 26.15 | 30.98 | 0.18 | | | 0.018 | 0.019 | 0.015 |
| | A12 | 0.60 | 1.28 | 0.016 | 0.022 | 0.0021 | bal. | 26.15 | 30.98 | 0.26 | | | 0.011 | 0.013 | 0.018 |
| | A13 | 0.58 | 1.31 | 0.022 | 0.015 | 0.0016 | bal. | 32.51 | 31.03 | 0.18 | | | 0.012 | 0.014 | 0.011 |
| | A14 | 0.51 | 1.34 | 0.019 | 0.012 | 0.0015 | bal. | 25.06 | 29.18 | 0.20 | 0.62 | | 0.016 | 0.010 | 0.016 |
| | A15 | 0.57 | 1.38 | 0.023 | 0.018 | 0.0022 | bal. | 25.88 | 30.12 | 0.25 | 1.57 | | 0.012 | 0.015 | 0.012 |
| | A16 | 0.62 | 1.29 | 0.035 | 0.014 | 0.0016 | bal. | 26.61 | 31.23 | 0.19 | 2.41 | | 0.013 | 0.011 | 0.015 |
| | A17 | 0.54 | 1.32 | 0.017 | 0.020 | 0.0015 | bal. | 26.61 | 30.54 | 0.18 | | 0.32 | 0.014 | 0.018 | 0.019 |
| | A18 | 0.60 | 1.40 | 0.024 | 0.011 | 0.0017 | bal. | 25.83 | 29.42 | 0.18 | | 1.20 | 0.018 | 0.013 | 0.012 |
| | A19 | 0.55 | 1.33 | 0.014 | 0.019 | 0.0020 | bal. | 26.01 | 31.15 | 0.21 | | 2.68 | 0.021 | 0.017 | 0.017 |
| | A20 | 0.50 | 1.31 | 0.012 | 0.014 | 0.0011 | bal. | 26.30 | 29.84 | 0.20 | 2.04 | 2.02 | 0.019 | 0.011 | 0.012 |
| Comparative Example | A21 | 0.52 | 1.28 | 0.022 | 0.010 | 0.0017 | bal. | 30.66 | 21.13 | | | | 0.019 | 0.015 | 0.014 |
| | A22 | 0.56 | 1.40 | 0.024 | 0.016 | 0.0020 | bal. | 26.18 | 31.20 | | | | 0.012 | 0.012 | 0.010 |
| | A23 | 0.55 | 1.62 | 0.018 | 0.017 | 0.0016 | bal. | 13.05 | 22.53 | | | | 0.018 | 0.016 | 0.011 |
| | A24 | 0.53 | 1.40 | 0.016 | 0.015 | 0.0014 | bal. | 46.76 | 25.31 | | | | 0.020 | 0.010 | 0.017 |
| | A25 | 0.43 | 1.38 | 0.017 | 0.027 | 0.0021 | 25.30 | 7.10 | bal. | 0.11 | 3.16 | 0.54 | 0.015 | 0.260 | 0.020 |

(Note)
The term "bal." in the chemical compositions of the alloy Nos. A1 to A24 means Cr and impurities that are not described in the Table.
The term "bal." in the chemical composition of the alloy No. A25 means Fe and impurities that are not described in the Table.

Each alloy product was manufactured according to the manufacturing method illustrated in FIG. 5. First, raw materials of each alloy were mixed and vacuum-melted ($2\times10^{-3}$ Pa or less, 1700° C. or more) using a high-frequency vacuum melting furnace, followed by solidification once, thereby forming a raw material alloy lump. Next, a re-melting process of the raw material alloy lump was performed using a vacuum arc re-melting furnace, thereby preparing a cleaned molten metal. Thereafter, the cleaned molten metal was cast using a predetermined mold, thereby manufacturing each alloy ingot.

Next, each ingot was molded by hot forging so as to have a predetermined shape. As hot forging conditions, a forging temperature was 1050 to 1300° C., a strain rate was 8 mm/s or less, a rolling reduction per forging was 10 mm or less, and the number of times of forging was six or more.

In addition, a forging temperature range was determined as follows. A test piece for a tensile test was separately cut out from the ingot of each Example subjected to heat treatment for adjusting a ferrite ratio and processed, and a high temperature tensile test (test temperature: 800 to 1350° C., Tensile speed: 10 mm/s) was performed on the test piece using a Greeble tester. A temperature range in which drawing was 60% or more as a result of the high-temperature tensile test was set as the forging temperature range.

Next, each alloy sample subjected to hot forging molding was subjected to solution heat treatment (holding at 1100 to 1250° C. for 1 hour, followed by water cooling). Thereafter, some of the samples were subjected to aging heat treatment (holding at 900 to 1000° C. for 1 hour, followed by water cooling). Alloy products (Examples 1 to 26 and Comparative Examples 1 to 5) for testing and evaluation were prepared through the above-mentioned processes.

Test and Evaluation on Alloy Products of Examples 1 to 26 and Comparative Examples 1 to 5

(1) Evaluation of Micro-Structure

After taking a test piece for observing a structure from each alloy product, a surface of the test piece was mirror-polished and electric field etching was performed thereon in an oxalic acid aqueous solution. The polished surface was observed using an optical microscope. FIG. 2 shown above is an optical microscope photograph of a metal structure of Example 6. It was separately confirmed that in other Examples, the same metal structure was observed.

Next, a ferrite ratio was measured as another evaluation method of the micro-structure. Electron backscattered diffraction pattern (EBSP) analysis was performed on the polished surface of the test piece for observing the structure, and the occupation rate of the ferrite phase (ferrite ratio, unit: %) was measured. A device in which a crystal orientation measuring device (manufactured by TSL Solutions KK) was added to a scanning electron microscope (S-4300SE, manufactured by Hitachi High-Technologies Corp.) was used in the measurement. The results are illustrated in the following Table 2.

(2) Evaluation of Mechanical Properties

As one of the evaluation of mechanical properties, a Vickers hardness test (load: 500 g, load application time: 20 s) was performed on the above-mentioned test piece for observing the structure using a Vickers hardness tester. Vickers hardness was obtained as an average value of five measurements. The results are also illustrated in Table 2.

Next, a test piece (diameter: 4 mm, parallel part length: 20 mm) for a tensile test was taken from each prepared alloy product.

As another evaluation method of mechanical properties, a room-temperature tensile test (strain rate: $3\times10^{-4}$ $s^{-1}$) was performed on each test piece using a tensile tester, thereby measuring 0.2% proof stress, tensile strength, elongation at break. When the test piece was broken before clear tensile strength was measured, the breaking stress was measured. These results of the tensile test were obtained as an average of three measurements.

As a result of measuring the elongation at break, a case in which the elongation at break was 15% or more was evaluated as rank A, a case in which the elongation at break was 5% or more and less than 15% was evaluated as rank B, a case in which the elongation at break was 2% or more and less than 5% was evaluated as rank C, and a case in which the elongation at break was less than 2% was evaluated as rank D. A case in which the evaluation result was equal to or higher than rank C was judged to pass, and a case in which the evaluation result was rank D was judged to fail. The results of the room-temperature tensile test are also illustrated in Table 2.

Next, a test piece (diameter: 10 mm, length: 20 mm) for an abrasion test was taken from each alloy product prepared above. As another evaluation method of mechanical properties, abrasion resistance of each test piece was evaluated using a pin-on-disk type friction abrasion tester.

A friction abrasion test method is as follows. Water-proof abrasive paper with a grain size of 240 was attached to a disk, the disk was rotated at a rotation speed of 200 rpm, and a test piece serving as a pin was pressed against the water-proof abrasive paper with a load of 4 kgf under a room-temperature atmospheric environment and moved from an outermost periphery (outermost diameter: 156 mm) of the water-proof abrasive paper towards the center (total movement distance of pin=about 6 m). The result of the friction abrasion test were obtained by measuring a change in length of the pin as an abrasion amount and calculating an average value of the two measurements.

As a reference sample for evaluating abrasion resistance, a commercially available cobalt-based alloy (Stellite (registered trademark), chemical composition: 59.5Co-29.2Cr-4.2W-2.9Fe-1.7Ni-1.2Si-1.17C-0.027N-0.0030-0.028P-0.0025S: % by mass) considered to have excellent abrasion resistance and corrosion resistance was used. As a result of the friction abrasion test, the abrasion amount of the reference sample was 0.087 mm. This abrasion amount was set as 100%, and a ratio of the abrasion amount of each alloy product was calculated. The results obtained by evaluating abrasion resistance are also illustrated in Table 2.

(3) Evaluation of Corrosion Resistance

A sulfuric acid resistance test was performed as a kind of an evaluation method of corrosion resistance. A test piece (13 mm in width×40 mm in length×3 mm in thickness) for testing sulfuric acid resistance was taken from each prepared alloy product, and sulfuric acid resistance was evaluated by a corrosion rate in sulfuric acid according to JIS G 0591 (2000). Specifically, a test in which the test piece was immersed in boiling 5% sulfuric acid for 6 hours was performed. A mass of each test piece before and after the test was measured, and an average mass decrease rate m (unit: $g/(m^2 \cdot h)$) due to corrosion was measured.

As a result of measuring the average mass decrease rate, "$m<0.1$" was evaluated as A rank, "$0.1 \leq m<0.3$" was evaluated as B rank, "$0.3 \leq m<0.5$" was evaluated as C rank, and "$0.5 \leq m$" was evaluated as D rank. A case in which the evaluation result was rank A was judged to pass, and a case in which the evaluation result equal to or lower than rank B was judged to fail. The results obtained by evaluating corrosion resistance are also illustrated in Table 2.

A pitting corrosion test was performed as another kind of evaluation method of corrosion resistance. A polarization test piece for the pitting corrosion test was taken from each alloy product in Examples. The pitting corrosion test was performed on each polarization test piece according to JIS G0577 (2005). Specifically, an electrode for preventing crevice corrosion was attached to the polarization test piece, a saturated calomel electrode was used as a reference electrode, an anode polarization curve of the polarization test piece was measured, and a pitting generation potential corresponding to a current density of 100 $\mu A/cm^2$ was obtained. After measuring the anode polarization curve, presence or absence of pitting corrosion was examined using an optical microscope.

As a result of the pitting corrosion test in each Example, the pitting corrosion potential corresponding to a current density of 100 $\mu A/cm^2$ was 1.0 V or more (vs. SHE), and in a transpassive region, oxygen was generated. Also, no pitting corrosion was observed in all of these samples.

TABLE 2

Manufacturing Conditions and Test Evaluation Results of Alloy Products in Examples 1 to 26 and Comparative Examples 1 to 5.

| | | Alloy No. | Solution Heat Treatment (° C.) | Aging Heat Treatment (° C.) | Ferrite Ratio (%) | Vickers Hardness (1 kg) | Proof Stress (MPa) | Tensile Strength (MPa) | Evaluation of Plastic Elongation | Evaluation of Sulfuric Acid Resistance | Evaluation of Abrasion Resistance |
|---|---|---|---|---|---|---|---|---|---|---|---|
| Example | 1 | A1 | 1100 | — | 79 | 571 | 1091 | 1120* | C | A | 51 |
| | 2 | A2 | 1100 | — | 45 | 420 | 936 | 1236* | B | A | 65 |
| | 3 | A3 | 1100 | — | 21 | 276 | 570 | 964 | A | A | 80 |
| | 4 | A4 | 1100 | — | 77 | 542 | 1072 | 1179* | C | A | 49 |
| | 5 | A5 | 1100 | — | 46 | 428 | 964 | 1186* | B | A | 68 |
| | 6 | A6 | 1100 | — | 45 | 417 | 946 | 1208* | B | A | 66 |
| | 7 | A6 | 1100 | 900 | 40 | 370 | 883 | 1187* | A | A | 71 |
| | 8 | A6 | 1200 | 1000 | 41 | 382 | 917 | 1270* | B | A | 68 |
| | 9 | A6 | 1250 | 1000 | 39 | 354 | 870 | 1205* | A | A | 72 |
| | 10 | A7 | 1100 | — | 46 | 408 | 937 | 1255* | B | A | 70 |
| | 11 | A8 | 1100 | — | 22 | 268 | 581 | 966 | A | A | 77 |
| | 12 | A9 | 1100 | — | 77 | 545 | 1121 | 1188* | C | A | 52 |
| | 13 | A10 | 1100 | — | 47 | 440 | 938 | 1215* | B | A | 67 |
| | 14 | A11 | 1100 | — | 48 | 438 | 965 | 1105* | C | A | 64 |
| | 15 | A11 | 1100 | 900 | 40 | 376 | 906 | 1202* | A | A | 72 |
| | 16 | A11 | 1200 | 1000 | 43 | 405 | 928 | 1240* | B | A | 69 |
| | 17 | A11 | 1250 | 1000 | 41 | 373 | 906 | 1275* | B | A | 65 |
| | 18 | A12 | 1100 | — | 48 | 419 | 969 | 1228* | B | A | 64 |
| | 19 | A13 | 1100 | — | 20 | 248 | 543 | 912 | B | A | 78 |
| | 20 | A14 | 1100 | — | 46 | 427 | 931 | 1150* | C | A | 70 |
| | 21 | A15 | 1200 | 1000 | 47 | 419 | 949 | 1254* | B | A | 68 |

TABLE 2-continued

Manufacturing Conditions and Test Evaluation Results of Alloy Products in Examples 1 to 26 and Comparative Examples 1 to 5.

| | | Alloy No. | Solution Heat Treatment (° C.) | Aging Heat Treatment (° C.) | Ferrite Ratio (%) | Vickers Hardness (1 kg) | Proof Stress (MPa) | Tensile Strength (MPa) | Evaluation of Plastic Elongation | Evaluation of Sulfuric Acid Resistance | Evaluation of Abrasion Resistance |
|---|---|---|---|---|---|---|---|---|---|---|---|
| | 22 | A16 | 1100 | — | 49 | 431 | 982 | 1237* | B | A | 68 |
| | 23 | A17 | 1100 | — | 48 | 422 | 963 | 1209* | B | A | 64 |
| | 24 | A18 | 1200 | 1000 | 47 | 417 | 944 | 1270* | B | A | 66 |
| | 25 | A19 | 1100 | — | 45 | 402 | 903 | 1248* | B | A | 71 |
| | 26 | A20 | 1100 | — | 47 | 429 | 942 | 1163* | C | A | 66 |
| Comparative Example | 1 | A21 | 1100 | — | 45 | 416 | 929 | 1261* | B | B | 69 |
| | 2 | A22 | 1100 | — | 46 | 422 | 964 | 1229* | B | B | 70 |
| | 3 | A23 | 1100 | — | 100 | 720 | Unmeasurable | 1342* | D | D | 39 |
| | 4 | A24 | 1100 | — | 0 | 175 | 256 | 529* | A | B | 182 |
| | 5 | A25 | 1100 | — | 46 | — | — | — | — | B | — |

(Note)
"*" means breaking stress,
"—" means that test was not performed.

As illustrated in Table 2, in Comparative Examples 1 to 5, the chemical composition of the alloy was out of the definition of the present invention, and there was a problem in one of mechanical properties (mechanical strength, ductility, and abrasion resistance) and corrosion resistance. More specifically, in Comparative Examples 3 and 4, since a ferrite ratio was out of the definition of the present invention, a disadvantage of a ferrite single phase or austenite single phase was clearly exhibited. Further, in Comparative Examples 1 and 2 in which a Sn component was not contained and Comparative Example 5 in which the commercially available two-phase stainless steel was used, the ferrite ratio was within the range of the present invention, but corrosion resistance was poor.

Further, as a result of evaluating corrosion resistance on the reference sample (commercially available cobalt-based alloy) for evaluating abrasion resistance, a sulfuric acid resistance test result was D rank, and in pitting generation potential measurement, a corrosion current density at a potential of 400 mV (vs. SHE) exceeded 100 $\mu A/cm^2$.

In contrast to these Comparative Examples, it was confirmed that all the alloys in the Examples according to the present invention were two-phase alloys each having a ferrite ratio in a range of 10 to 95%, excellent mechanical properties (for example, Vickers hardness of 250 Hv or more, 0.2% proof stress of 500 MPa or more, tensile strength/breaking stress of 850 MPa or more, and elongation at break of 2% or more), and excellent corrosion resistance. In addition, it was confirmed that the ferrite ratio tended to increase in accordance with an increase in the content of Cr, and the Vickers hardness and the 0.2% proof stress tended to increase in accordance with an increase in ferrite ratio.

(4) Evaluation of Structural Stability

Next, in view of long-term reliability of the alloy product, a structural stability test was performed. After taking a test piece for the structural stability test from the alloy product in each Example, heat treatment of holding at 800° C. for 60 minutes was performed thereon. X-ray diffraction measurement was performed on a surface of each test piece, and the presence or absence of formation of a σ phase of an intermetallic compound was investigated. As a result of the investigation, it was confirmed that in all the Examples according to the present invention, the σ phase was not detected and formation of the σ phase was difficult.

Experiment 2

Manufacturing of Alloy Products in Examples 27 to 44

Alloy products (Examples 27 to 44) were manufactured using alloys B1 to B16 having chemical compositions illustrated in Table 3, respectively. Each alloy product was manufactured according to the manufacturing method illustrated in FIG. 5, similarly in Experiment 1.

A content (unit: % by mass) of each component in Table 3 was converted so that a total content of the chemical composition illustrated in Table 3 was 100% by mass. Further, a numerical value in parentheses in V, Nb, Ta and Ti in Table 3 means a ratio (ratio in at %) of the corresponding element to a total atomic content (at %) of C, N and O.

TABLE 3

Chemical Compositions of Alloys B1 to B16.

| | | Chemical Composition [% by mass] | | | | | | | | | | | |
|---|---|---|---|---|---|---|---|---|---|---|---|---|---|
| | Alloy No. | Si | Mn | Al | P | S | Cr | Ni | Fe | Sn | Mo | Cu | V |
| Example | B1 | 0.55 | 1.33 | 0.021 | 0.013 | 0.0014 | bal. | 25.89 | 12.03 | 0.17 | | | 0.18 (131) |
| | B2 | 0.51 | 1.27 | 0.016 | 0.014 | 0.0019 | bal. | 33.20 | 12.31 | 0.20 | | | |
| | B3 | 0.48 | 1.31 | 0.018 | 0.015 | 0.0021 | bal. | 38.69 | 11.90 | 0.19 | | | |
| | B4 | 0.51 | 1.26 | 0.026 | 0.020 | 0.0023 | bal. | 21.14 | 18.83 | 0.19 | | | |
| | B5 | 0.59 | 1.34 | 0.032 | 0.014 | 0.0016 | bal. | 30.67 | 20.83 | 0.06 | | | |
| | B6 | 0.56 | 1.36 | 0.026 | 0.013 | 0.0025 | bal. | 31.13 | 20.62 | 0.18 | | | |
| | B7 | 0.54 | 1.37 | 0.014 | 0.017 | 0.0024 | bal. | 29.86 | 20.51 | 0.25 | | | |
| | B8 | 0.62 | 1.41 | 0.019 | 0.016 | 0.0020 | bal. | 37.66 | 20.69 | 0.19 | | | |

TABLE 3-continued

Chemical Compositions of Alloys B1 to B16.

| | | | | | | | | | | | | |
|---|---|---|---|---|---|---|---|---|---|---|---|---|
| B9 | 0.55 | 1.44 | 0.020 | 0.013 | 0.0016 | bal. | 20.32 | 28.04 | 0.20 | | | 0.21 (132) |
| B10 | 0.56 | 1.31 | 0.023 | 0.020 | 0.0022 | bal. | 26.18 | 30.21 | 0.07 | | | 0.15 (0.86) |
| B11 | 0.53 | 1.36 | 0.018 | 0.014 | 0.0019 | bal. | 26.37 | 31.25 | 0.18 | | | |
| B12 | 0.46 | 1.21 | 0.022 | 0.019 | 0.0025 | bal. | 26.65 | 30.43 | 0.27 | | | |
| B13 | 0.51 | 1.39 | 0.025 | 0.021 | 0.0021 | bal. | 32.61 | 31.22 | 0.21 | | | 0.09 (0.57) |
| B14 | 0.57 | 1.35 | 0.033 | 0.017 | 0.0012 | bal. | 25.92 | 31.06 | 0.20 | 2.10 | | |
| B15 | 0.53 | 1.27 | 0.027 | 0.016 | 0.0023 | bal. | 25.83 | 30.48 | 0.18 | | 2.07 | |
| B16 | 0.58 | 1.32 | 0.021 | 0.015 | 0.0018 | bal. | 26.16 | 29.24 | 0.19 | 1.98 | 2.08 | 0.10 (0.72) |

| | | Chemical Composition [% by mass] | | | | | |
|---|---|---|---|---|---|---|---|
| | Alloy No. | Nb | Ta | Ti | C | N | O |
| Example | B1 | | | | 0.013 | 0.012 | 0.012 |
| | B2 | 0.32 (1.18) | | | 0.011 | 0.017 | 0.013 |
| | B3 | | 0.88 (1.53) | | 0.015 | 0.011 | 0.018 |
| | B4 | | | 0.14 (0.89) | 0.016 | 0.016 | 0.011 |
| | B5 | 0.40 (1.78) | | | 0.011 | 0.010 | 0.013 |
| | B6 | | | 0.19 (121) | 0.016 | 0.013 | 0.015 |
| | B7 | | | 0.29 (1.67) | 0.019 | 0.019 | 0.011 |
| | B8 | 0.15 (0.64) | | 0.08 (0.68) | 0.011 | 0.013 | 0.010 |
| | B9 | | 0.15 (0.34) | 0.11 (0.91) | 0.013 | 0.012 | 0.019 |
| | B10 | | | | 0.016 | 0.015 | 0.012 |
| | B11 | | 0.26 (0.42) | | 0.021 | 0.010 | 0.016 |
| | B12 | 0.35 (1.34) | | | 0.012 | 0.017 | 0.010 |
| | B13 | 0.26 (0.95) | | | 0.011 | 0.014 | 0.016 |
| | B14 | 0.27 (0.92) | | | 0.016 | 0.013 | 0.014 |
| | B15 | 0.35 (1.34) | | | 0.014 | 0.012 | 0.013 |
| | B16 | | | 0.09 (0.65) | 0.015 | 0.014 | 0.009 |

(Note)

The term "bal." in the chemical compositions of alloy Nos. B1 to B16 means Cr and impurities that are not described in the Table.

The numerical value in parentheses in V, Nb, Ta and Ti means a ratio of the corresponding element to the total atomic content (at %) of C, N and O.

Test and Evaluation of Alloy Products in Examples 27 to 44

Micro structures, mechanical properties, corrosion resistance, and structural stability of the alloy products in Examples 27 to 44 were evaluated similarly in Experiment 1. The results are illustrated in Table 4.

TABLE 4

Manufacturing Conditions and Test Evaluation Results of Alloy Products in Examples 27 to 44.

| | | Alloy No. | Solution Heat Treatment (° C.) | Aging Heat Treatment (° C.) | Ferrite Ratio (%) | Vickers Hardness (1 kg) | Proof Stress (MPa) | Tensile Strength (MPa) | Evaluation of Plastic Elongation | Evaluation of Sulfuric Acid Resistance | Evaluation of Abrasion Resistance |
|---|---|---|---|---|---|---|---|---|---|---|---|
| Example | 27 | B1 | 1100 | 900 | 53 | 441 | 984 | 1270* | B | A | 67 |
| | 28 | B2 | 1100 | 900 | 40 | 370 | 868 | 1168* | A | A | 69 |
| | 29 | B3 | 1100 | 900 | 29 | 327 | 705 | 985 | A | A | 74 |
| | 30 | B4 | 1100 | 900 | 66 | 492 | 1068 | 1173* | C | A | 58 |
| | 31 | B5 | 1100 | 900 | 39 | 377 | 881 | 1146* | A | A | 71 |
| | 32 | B6 | 1100 | 800 | 40 | 381 | 874 | 1112 | A | A | 68 |
| | 33 | B6 | 1100 | 900 | 38 | 358 | 880 | 1129* | B | A | 72 |
| | 34 | B6 | 1100 | 1000 | 41 | 365 | 912 | 1180* | B | A | 67 |
| | 35 | B7 | 1100 | 900 | 40 | 373 | 897 | 1136 | A | A | 72 |
| | 36 | B8 | 1100 | 900 | 25 | 284 | 630 | 907 | A | A | 66 |
| | 37 | B9 | 1100 | 900 | 57 | 450 | 1016 | 1209* | C | A | 60 |
| | 38 | B10 | 1100 | 900 | 39 | 372 | 872 | 1150* | A | A | 70 |
| | 39 | B11 | 1100 | 900 | 40 | 368 | 917 | 1182* | B | A | 67 |
| | 40 | B12 | 1100 | 900 | 41 | 384 | 896 | 1135* | B | A | 68 |
| | 41 | B13 | 1100 | 900 | 25 | 277 | 640 | 894 | A | A | 75 |
| | 42 | B14 | 1100 | 900 | 41 | 390 | 899 | 1165* | B | A | 71 |
| | 43 | B15 | 1100 | 900 | 38 | 376 | 875 | 1121* | A | A | 74 |
| | 44 | B16 | 1100 | 900 | 40 | 389 | 911 | 1174* | B | A | 71 |

(Note)

"*" means breaking stress.

As illustrated in Table 4, it was confirmed that all the alloys in the Examples 27 to 44 according to the present invention were two-phase alloys each having a ferrite ratio in a range of 10 to 95%, excellent mechanical properties (for example, Vickers hardness of 250 Hv or more, 0.2% proof stress of 500 MPa or more, tensile strength/breaking stress of 850 MPa or more, and elongation at break of 2% or more), and excellent corrosion resistance.

Further, at the time of evaluating the structural stability, in all the Examples 27 to 44 according to the present invention, a σ phase was not detected and formation of the σ phase was difficult.

Experiment 3

Manufacturing of Alloy Products of Examples 45 to 62 and Comparative Examples 6 to 10

Alloy products (Examples 45 to 62 and Comparative Examples 6 to 10) were manufactured using alloys C1 to C23 having chemical compositions illustrated in Table 5, respectively. A content (unit: % by mass) of each component was converted so that a total content of the chemical composition illustrated in Table 5 was 100% by mass. Further, a numerical value in parentheses in V, Nb, Ta and Ti in Table 5 means a ratio (ration in at %) of the corresponding element to a total atomic content (at %) of C, N and O.

TABLE 5

Chemical Compositions of Alloys C1 to C23.

| | | Chemical Composition [% by mass] | | | | | | | | | | | | |
|---|---|---|---|---|---|---|---|---|---|---|---|---|---|---|
| | Alloy No. | Si | Mn | Al | P | S | Cr | Ni | Fe | Co | Sn | Mo | W | Cu |
| Example | C1 | 0.51 | 1.33 | 0.037 | 0.012 | 0.0016 | bal. | 20.87 | 19.44 | | 0.18 | | | |
| | C2 | 0.50 | 1.23 | 0.031 | 0.013 | 0.0014 | bal. | 29.78 | 20.40 | | 0.07 | | | |
| | C3 | 0.48 | 1.30 | 0.034 | 0.017 | 0.0015 | bal. | 29.61 | 20.38 | | 0.19 | 1.92 | | |
| | C4 | 0.53 | 1.35 | 0.036 | 0.011 | 0.0013 | bal. | 29.87 | 19.93 | | 0.18 | | | 1.87 |
| | C5 | 0.54 | 1.27 | 0.035 | 0.017 | 0.0016 | bal. | 36.15 | 20.62 | | 0.19 | | | |
| | C6 | 0.48 | 1.34 | 0.032 | 0.021 | 0.0016 | bal. | 20.62 | 19.47 | | 0.20 | | | |
| | C7 | 0.49 | 1.26 | 0.020 | 0.023 | 0.0017 | bal. | 30.10 | 20.64 | | 0.06 | | | |
| | C8 | 0.56 | 1.21 | 0.034 | 0.015 | 0.0013 | bal. | 36.02 | 20.15 | | 0.20 | | | |
| | C9 | 0.52 | 1.36 | 0.026 | 0.014 | 0.0020 | bal. | 25.32 | 28.67 | | 0.17 | | | |
| | C10 | 0.53 | 1.22 | 0.038 | 0.015 | 0.0018 | bal. | 26.15 | 29.81 | | 0.18 | 1.87 | | 1.92 |
| | C11 | 0.48 | 1.30 | 0.030 | 0.014 | 0.0012 | bal. | 20.84 | 19.13 | | 0.18 | | | |
| | C12 | 0.45 | 1.27 | 0.031 | 0.016 | 0.0018 | bal. | 30.08 | 19.17 | | 0.06 | | | |
| | C13 | 0.52 | 1.30 | 0.031 | 0.014 | 0.0011 | bal. | 36.51 | 20.11 | | 0.19 | 1.93 | | 2.04 |
| | C14 | 0.51 | 1.28 | 0.038 | 0.013 | 0.0016 | bal. | 20.79 | 19.41 | | 0.19 | | | |
| | C15 | 0.48 | 1.25 | 0.038 | 0.021 | 0.0020 | bal. | 29.82 | 19.81 | | 0.21 | 2.11 | | |
| | C16 | 0.64 | 1.35 | 0.036 | 0.019 | 0.0016 | bal. | 35.31 | 20.06 | | 0.20 | | | 1.72 |
| | C17 | 0.52 | 1.30 | 0.038 | 0.016 | 0.0020 | bal. | 25.32 | 29.67 | | 0.06 | | | |
| | C18 | 0.49 | 1.31 | 0.032 | 0.013 | 0.0016 | bal. | 25.15 | 29.18 | | 0.19 | 1.93 | | 1.91 |
| Comparative Example | C19 | 0.51 | 1.22 | 0.042 | 0.012 | 0.0014 | bal. | 29.72 | 20.16 | | | | | |
| | C20 | 0.53 | 1.30 | 0.035 | 0.014 | 0.0013 | bal. | 12.96 | 21.48 | | | | | |
| | C21 | 0.40 | 1.29 | 0.024 | 0.025 | 0.0020 | 25.10 | 8.90 | bal. | | 0.10 | 3.01 | | 0.47 |
| | C22 | 0.54 | 1.20 | 0.034 | 0.013 | 0.0015 | bal. | 30.45 | 20.64 | | | | | |
| | C23 | 0.52 | 1.43 | 0.029 | 0.020 | 0.0016 | bal. | 13.02 | 22.05 | | | | | |

| | | Chemical Composition [% by mass] | | | | | | |
|---|---|---|---|---|---|---|---|---|
| | Alloy No. | V | Nb | Ta | Ti | C | N | O |
| Example | C1 | | | | | 0.013 | 0.018 | 0.023 |
| | C2 | | | | | 0.012 | 0.020 | 0.021 |
| | C3 | | | | | 0.016 | 0.016 | 0.020 |
| | C4 | | | | | 0.013 | 0.018 | 0.019 |
| | C5 | | | | | 0.014 | 0.021 | 0.024 |
| | C6 | 0.25 (1.42) | | | | 0.011 | 0.019 | 0.018 |
| | C7 | | 0.31 (0.9) | | | 0.015 | 0.016 | 0.021 |
| | C8 | | | 1.15 (1.62) | | 0.017 | 0.020 | 0.017 |
| | C9 | | | | 0.26 (1.58) | 0.016 | 0.015 | 0.016 |
| | C10 | | 0.29 (0.84) | | 0.16 (0.92) | 0.012 | 0.022 | 0.018 |
| | C11 | | | | | 0.017 | 0.016 | 0.038 |
| | C12 | | | | | 0.020 | 0.018 | 0.042 |
| | C13 | | | | | 0.016 | 0.021 | 0.034 |
| | C14 | 0.35 (1.62) | | | | 0.019 | 0.013 | 0.028 |
| | C15 | | 0.52 (1.31) | | | 0.014 | 0.017 | 0.030 |
| | C16 | | — | 0.67 (0.87) | | 0.012 | 0.022 | 0.027 |
| | C17 | | | | 0.31 (1.53) | 0.011 | 0.019 | 0.031 |
| | C18 | | 0.26 (0.72) | | 0.16 (0.87) | 0.014 | 0.017 | 0.025 |

TABLE 5-continued

| Chemical Compositions of Alloys C1 to C23. | | | | |
|---|---|---|---|---|
| Comparative Example | C19 | 0.018 | 0.011 | 0.012 |
| | C20 | 0.012 | 0.015 | 0.018 |
| | C21 | 0.012 | 0.250 | 0.021 |
| | C22 | 0.015 | 0.020 | 0.027 |
| | C23 | 0.011 | 0.021 | 0.029 |

(Note)

The term "bal." in the chemical compositions of alloy Nos. C1 to C20, C22 and C23 means Cr and impurities that are not described in the Table.

The term "bal." in the chemical composition of the alloy No. C21 means Fe and impurities that are not described in the Table.

The numerical value in parentheses in V, Nb, Ta and Ti means a ratio of the corresponding element to the total atomic content (at %) of C, N and O.

The alloy products in Examples 45 to 54 and Comparative Examples 6 and 7 were manufactured according to the manufacturing method illustrated in FIG. 4.

Meanwhile, in manufacturing of the alloy products in Examples 55 to 62 and Comparative Examples 8 to 10, after alloy powder was manufactured according to the manufacturing method illustrated in FIG. 6, a composite body in which an alloy coating layer was formed on a substrate by build-up welding using the alloy powder was manufactured.

Figure 7:
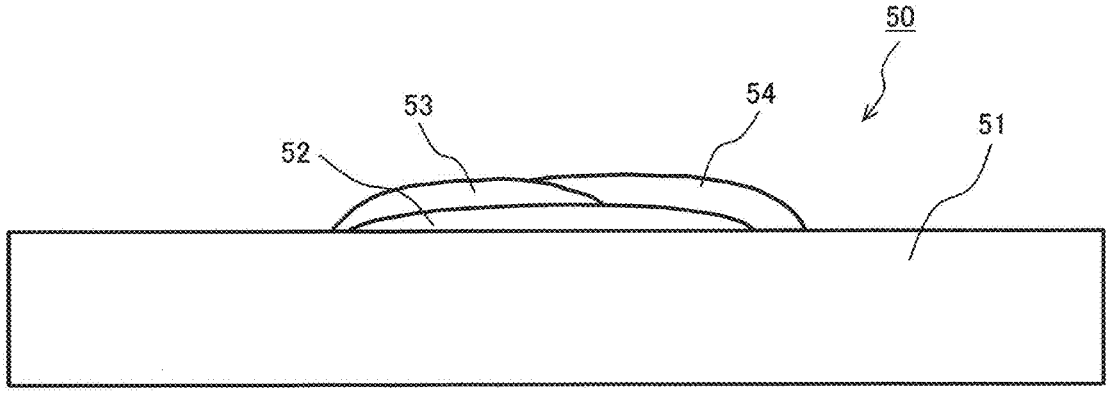
FIG. 7 is a schematic cross-sectional view illustrating an example of a composite body in which a coating layer is formed on a substrate by build-up welding.

FIG. 7 is a schematic cross-sectional view illustrating an example of the composite body in which the coating layer was formed on the substrate by build-up welding. As illustrated in FIG. 7, the composite body 50 was formed by forming alloy coating layers 52 to 54 on a substrate 51 made of commercially available SUS 304 steel by a powder plasma build-up welding method so as to have a total thickness of about 5 mm. As welding conditions, an arc current was 120 A, a voltage was 25 V, and a welding speed was 9 cm/min.

Test and Evaluation on Alloy Products of Examples 45 to 62 and Comparative Examples 6 to 10

Micro structures, mechanical properties, corrosion resistance, and structural stability of the alloy products in Examples 45 to 62 and Comparative Examples 6 to 10 were evaluated similarly in Experiment 1. The results are illustrated in Table 6. In addition, FIG. 1 is an optical microscope photograph of a metal structure of Example 45, and FIG. 3 is an optical microscope photograph of a metal structure of Example 58. It was separately confirmed that in each of other Examples, the same metal structure was observed.

TABLE 6

Manufacturing Conditions and Test Evaluation Results of Alloy Products in Examples 45 to 62 and Comparative Examples 6 to 11.

| | | Alloy No. | Solution Heat Treatment (° C.) | Aging Heat Treatment (° C.) | Ferrite Ratio (%) | Vickers Hardness (1 kg) | Proof Stress (MPa) | Tensile Strength (MPa) | Evaluation of Plastic Elongation | Evaluation of Sulfuric Acid Resistance | Evaluation of Abrasion Resistance |
|---|---|---|---|---|---|---|---|---|---|---|---|
| Example | 45 | C1 | — | — | 83 | 602 | 1114 | 1204* | C | A | 47 |
| | 46 | C2 | — | — | 64 | 516 | 1062 | 1179* | C | A | 60 |
| | 47 | C3 | — | — | 62 | 520 | 1041 | 1162* | C | A | 58 |
| | 48 | C4 | — | — | 64 | 523 | 1065 | 1206* | C | A | 59 |
| | 49 | C5 | — | — | 24 | 292 | 670 | 884 | A | A | 78 |
| | 50 | C6 | 1100 | — | 64 | 574 | 1077 | 1162* | C | A | 61 |
| | 51 | C7 | — | — | 63 | 509 | 1046 | 1180* | C | A | 59 |
| | 52 | C8 | — | — | 26 | 298 | 704 | 985 | A | A | 73 |
| | 53 | C9 | 1200 | 900 | 42 | 365 | 920 | 1175* | B | A | 69 |
| | 54 | C10 | — | — | 66 | 514 | 1065 | 1161* | C | A | 58 |
| | 55 | C11 | — | — | 86 | 722 | — | — | — | A | 46 |
| | 56 | C12 | — | — | 67 | 586 | — | — | — | A | 60 |
| | 57 | C13 | — | — | 24 | 302 | — | — | — | A | 76 |
| | 58 | C14 | — | — | 80 | 711 | — | — | — | A | 51 |
| | 59 | C15 | — | — | 65 | 574 | — | — | — | A | 58 |
| | 60 | C16 | — | — | 26 | 292 | — | — | — | A | 77 |
| | 61 | C17 | — | — | 66 | 544 | — | — | — | A | 60 |
| | 62 | C18 | — | — | 68 | 530 | — | — | — | A | 52 |
| Comparative Example | 6 | C19 | — | — | 64 | 496 | 1044 | 1148* | C | B | 57 |
| | 7 | C20 | — | — | 100 | 704 | Unmeasurable | 1351* | D | D | 42 |
| | 8 | C21 | — | — | 60 | — | — | | — | C | — |
| | 9 | C22 | — | — | 66 | 571 | — | | — | B | 58 |
| | 10 | C23 | — | — | 100 | 792 | — | | — | D | 40 |

(Note)

"*" means breaking stress.

"—" means that test was not performed.

As illustrated in Table 6, in Comparative Examples 6 to 10, the chemical composition of the alloy was out of the definition of the present invention, and there was a problem in one of the mechanical properties (ductility and abrasion resistance) and corrosion resistance. More specifically, in Comparative Examples 6 and 9 in which a Sn component was not contained, a ferrite ratio was within the range of the present invention, but corrosion resistance was poor. In Comparative Examples 7, 8, and 10, since a ferrite ratio was out of the definition of the present invention, a disadvantage of a ferrite single phase or austenite single phase was clearly exhibited.

In contrast to these Comparative Examples, it was confirmed that all the alloys in Examples according to the present invention were two-phase alloys each having a ferrite ratio in a range of 10 to 95%, excellent mechanical properties (for example, Vickers hardness of 250 Hv or more, 0.2% proof stress of 500 MPa or more, tensile strength/breaking stress of 850 MPa or more, and elongation at break of 2% or more), and excellent corrosion resistance.

From the test and evaluation results described above, it was confirmed that in Examples according to the present invention, the alloy product simultaneously had good mechanical properties and excellent corrosion resistance at least equivalent to those in conventional materials. Further, it can be said that since the content of the Cr component was high, it is possible to decrease a cost as compared to conventional Ni-based alloy materials.

The above-mentioned exemplary embodiments and Examples are described in order to assisting in understanding of the present invention, and the present invention is not limited only to specific configurations described above. For example, some of the configurations of an exemplary embodiment can be replaced with those of another exemplary embodiment, and a configuration of another exemplary embodiment can be added to a configuration of an exemplary embodiment. That is, some of the configurations of the exemplary embodiment or the examples can be deleted, replaced with other configurations, or other configurations can be added thereto.

LEGEND

P1 . . . austenite phase;
P2 . . . ferrite phase;
10 . . . molten metal;
11 . . . cleaned molten metal;
20 . . . ingot;
30 . . . molded body;
40 . . . alloy powder;
50 . . . composite body;
51 . . . substrate; and
52-54 . . . alloy coating layers.

The invention claimed is:

1. A Cr-based two-phase alloy comprising two phases of a ferrite phase and an austenite phase that are mixed with each other, wherein a chemical composition of the Cr-based two-phase alloy consists of a main component, an auxiliary component, impurities, a first optional auxiliary component, and a second optional auxiliary component, the main component consists of 37.28% by mass or more to 61% by mass or less of Cr, 18% by mass or more to 40% by mass or less of Ni, and 10% by mass or more to 33% by mass or less of Fe, and a total content of the Ni and the Fe is 37% by mass or more to 62.495% by mass or less, the auxiliary component consists of 0.1% by mass or more to 2% by mass or less of Mn, 0.1% by mass or more to 1% by mass or less of Si, 0.005% by mass or more to 0.05% by mass or less of Al, and 0.02% by mass or more to 0.3% by mass or less of Sn, the impurities contain more than 0% by mass to 0.04% by mass or less of P, more than 0% by mass to 0.01% by mass or less of S, more than 0% by mass to 0.03% by mass or less of C, more than 0% by mass to 0.04% by mass or less of N, and more than 0% by mass to 0.05% by mass or less of O, and the first optional auxiliary component is 0.1% by mass or more to 3% by mass or less of Mo and 0.1% by mass or more to 5% by mass or less of Cu.

2. The Cr-based two-phase alloy according to claim 1, wherein the second optional auxiliary component consists of at least one of V, Nb, Ta and Ti, and when the Cr-based two-phase alloy contains the second optional auxiliary component, a total atomic content of V, Nb, Ta and Ti is in a range of 0.8 times or more to 2 times or less a total atomic content of C, N and O.

3. The Cr-based two-phase alloy according to claim 1, wherein an occupation ratio of the ferrite phase is 10% or more to 95% or less.

4. The Cr-based two-phase alloy according to claim 1, wherein the Cr-based two-phase alloy is a powder.

5. The Cr based two-phase alloy according to claim 2, wherein an occupation ratio of the ferrite phase is 10% or more and 95% or less.

6. A high corrosion resistant device comprising:

a compressor;

a pump; and two phases of a ferrite phase and an austenite phase that are mixed with each other, wherein a chemical composition of the Cr-based two-phase alloy consists of a main component, an auxiliary component, impurities, a first optional auxiliary component, and a second optional auxiliary component, the main component consists of 37.28% by mass or more to 61% by mass or less of Cr, 18% by mass or more to 40% by mass or less of Ni, and 10% by mass or more to 33% by mass or less of Fe, and a total content of the Ni and the Fe is 37% by mass or more to 62.495% by mass or less, the auxiliary component consists of 0.1% by mass or more to 2% by mass or less of Mn, 0.1% by mass or more to 1% by mass or less of Si, 0.005% by mass or more to 0.05% by mass or less of Al, and 0.02% by mass or more to 0.3% by mass or less of Sn, the impurities contain more than 0% by mass to 0.04% by mass or less of P, more than 0% by mass to 0.01% by mass or less of S, more than 0% by mass to 0.03% by mass or less of C, more than 0% by mass to 0.04% by mass or less of N, and more than 0% by mass to 0.05% by mass or less of 0, and the first optional auxiliary component is 0.1% by mass or more to 3% by mass or less of Mo and 0.1% by mass or more to 5% by mass or less of Cu.

7. The high corrosion resistant device according to claim 6, wherein the high corrosion resistant device is a molded body having a cast structure.

8. The high corrosion resistant device according to claim 6, wherein the high corrosion resistant device is a molded body having a forged structure.

9. The high corrosion resistant device according to claim 6, wherein the high corrosion resistant device is a composite body in which a coating layer of the two-phase alloy is on a substrate, and the coating layer has a rapid solidification structure.

* * * * *